US012467200B2

(12) United States Patent
Hashimoto

(10) Patent No.: US 12,467,200 B2
(45) Date of Patent: Nov. 11, 2025

(54) WIRE ROPE

(71) Applicant: ASAHI INTECC CO., LTD., Seto (JP)

(72) Inventor: Takaya Hashimoto, Seto (JP)

(73) Assignee: ASAHI INTECC CO., LTD., Seto (JP)

( * ) Notice: Subject to any disclaimer, the term of this patent is extended or adjusted under 35 U.S.C. 154(b) by 0 days.

(21) Appl. No.: 18/643,643

(22) Filed: Apr. 23, 2024

(65) Prior Publication Data

US 2024/0271362 A1 Aug. 15, 2024

Related U.S. Application Data

(63) Continuation of application No. PCT/JP2022/039290, filed on Oct. 21, 2022.

(30) Foreign Application Priority Data

Oct. 27, 2021 (JP) ..... 2021-175450

(51) Int. Cl.
*D07B 1/06* (2006.01)

(52) U.S. Cl.
CPC ..... *D07B 1/068* (2013.01)

(58) Field of Classification Search
USPC ..... 57/212
See application file for complete search history.

(56) References Cited

U.S. PATENT DOCUMENTS 251,114 A * 12/1881 Hallidie ..... D07B 1/0693 57/215
2,400,181 A * 5/1946 Warren, Jr. ..... D07B 1/005 57/240
3,131,469 A * 5/1964 Glaze ..... D07B 1/14 428/605
3,383,704 A * 5/1968 Schoerner ..... D07B 5/007 57/215
3,778,993 A * 12/1973 Glushko ..... D07B 1/22 29/520

(Continued)

FOREIGN PATENT DOCUMENTS

AU 745343 B2 * 3/2002 ..... D07B 1/0686
DE 102012023955 A1 * 10/2013 ..... D07B 1/147

(Continued)

OTHER PUBLICATIONS

"What is Swaging?" Suncor Stainless. Mar. 28, 2021. https://suncorstainless.com/knowledgebase/swaging/ (Year: 2021).*

*Primary Examiner* — Grace Huang
(74) *Attorney, Agent, or Firm* — Oliff PLC

(57) ABSTRACT

A wire rope includes a strand that is formed by winding a plurality of metal wires. The strand includes a core wire and side wires. Each of the side wires is arranged on an outer periphery of the core wire. In a transverse section of the strand, each of the side wires includes end portions positioned at opposite ends in a circumferential direction of the core wire. Each of the end portions includes a contact portion in contact with an end portion of an adjacent side wire, and a non-contact portion not in contact with the adjacent side wire. A Vickers hardness of the contact portion is higher by 1% or more than a Vickers hardness of the non-contact portion. A surface roughness Ra of an outer peripheral surface of each of the side wires is 0.10 μm or less.

3 Claims, 3 Drawing Sheets

(56) References Cited

U.S. PATENT DOCUMENTS

| | | | | | |
|---|---|---|---|---|---|
| 4,270,341 | A * | 6/1981 | Glushko | D07B 5/007 | 57/215 |
| 4,529,837 | A * | 7/1985 | Borden | H01B 12/02 | 57/215 |
| 4,604,861 | A * | 8/1986 | Matsuura | D07B 7/025 | 57/311 |
| 5,946,898 | A * | 9/1999 | Kurata | D07B 5/007 | 57/220 |
| 6,260,343 | B1 * | 7/2001 | Pourladian | D07B 5/12 | 57/200 |
| 8,881,521 | B2 * | 11/2014 | Browne | E01D 19/16 | 60/527 |
| 8,991,457 | B2 * | 3/2015 | Kudo | B60C 9/0007 | 57/902 |
| 9,162,849 | B2 * | 10/2015 | Mitsui | D07B 1/08 | |
| 11,400,766 | B2 * | 8/2022 | Liu | D07B 1/062 | |
| 11,993,894 | B2 * | 5/2024 | De Roose | B66B 7/06 | |
| 2017/0328000 | A1 | 11/2017 | Hashimoto | | |

FOREIGN PATENT DOCUMENTS

| | | | | | |
|---|---|---|---|---|---|
| JP | 58120891 | U * | 1/1982 | D07B 2201/2002 | |
| JP | H11-047153 | A | 2/1999 | | |
| JP | 2004124342 | A * | 4/2004 | | |
| JP | WO2017/195284 | A1 | 6/2018 | | |
| WO | WO-2012050997 | A1 * | 4/2012 | D07B 1/144 | |
| WO | WO-2021033497 | A1 * | 2/2021 | D07B 1/0673 | |

* cited by examiner

WIRE ROPE

CROSS REFERENCE TO RELATED APPLICATIONS

This application is a continuation application of International Application No. PCT/JP2022/039290, filed Oct. 21, 2022, which claims priority to Japanese Patent Application No. 2021-175450, filed Oct. 27, 2021. The contents of these applications are incorporated herein by reference in their entirety.

TECHNICAL FIELD

The present disclosure relates to a wire rope.

BACKGROUND

Japanese Patent Application Publication No. H11-47153 discloses an elastic wire that is formed by performing swaging processing on a twisted wire formed by twisting a plurality of wires with a circular cross section so that each wire is compressed and deformed to have a noncircular cross section.

SUMMARY

The elastic wire of Japanese Patent Application Publication No. H11-47153 is formed by swaging processing, and thus a hardness distribution in a transverse section of a side wire is substantially uniform, and a surface roughness of an outer surface of the side wire is not smooth. Therefore, the elastic wire of Japanese Patent Application Publication No. H11-47153 is poor in bending durability.

One object of the present disclosure is to provide a wire rope capable of improving bending durability.

A wire rope according to one aspect of the present disclosure includes a strand formed by winding a plurality of metal wires. The strand includes a core wire arranged in a center of the plurality of metal wires, and side wires that make up a remainder of the plurality of metal wires. Each of the side wires is arranged on an outer periphery of the core wire. In a transverse section of the strand, each of the side wires includes end portions positioned at opposite ends in a circumferential direction of the core wire. Each of the end portions includes a contact portion in contact with an end portion of an adjacent side wire, and a non-contact portion not in contact with the adjacent side wire. A Vickers hardness of the contact portion is higher by 1% or more than a Vickers hardness of the non-contact portion. A surface roughness Ra of an outer peripheral surface of each of the side wires is 0.10 μm or less.

DETAILED DESCRIPTION

Figure 1:
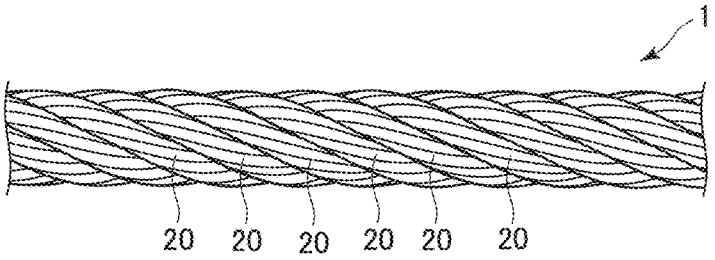
FIG. 1 is an external view of a wire rope according to an embodiment.

Hereinafter, one embodiment of the present disclosure is described with reference to drawings. However, the present disclosure is not limited to only the embodiments illustrated in the drawings.

Figure 2:
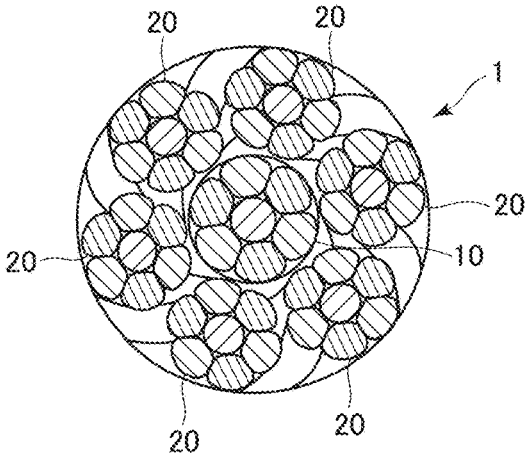
FIG. 2 is a transverse sectional view of the wire rope.
Figure 3:
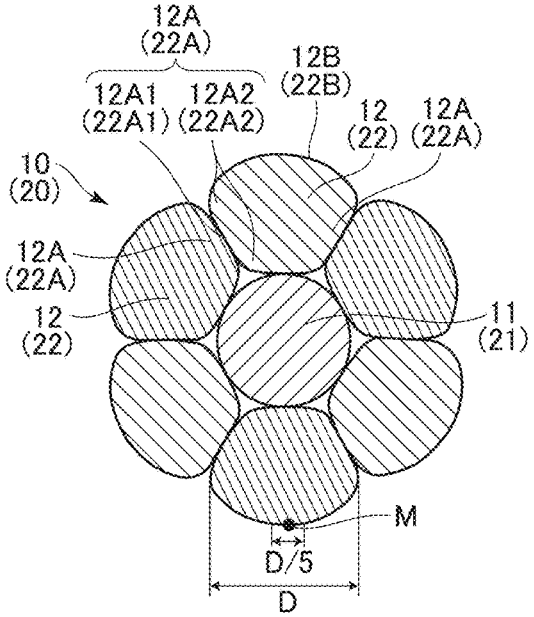
FIG. 3 is a transverse sectional view of a core strand (side strands)

FIG. 1 is an external view of a wire rope 1 according to an embodiment of the present disclosure. FIG. 2 is a transverse sectional view of the wire rope 1. FIG. 3 is a transverse sectional view of a core strand 10 (side strands 20).

As illustrated in FIGS. 1 and 2, the wire rope 1 includes the core strand 10, a plurality (six, for example) of side strands 20, and is formed by a twisted wire in which they are twisted. The core strand 10 and the side strands 20 are each formed by a twisted wire in which a plurality (seven, for example) of wires are twisted. As illustrated in FIG. 3, the core strand 10 includes, among a plurality of wires, a core wire 11 arranged in the center of the core strand 10 and side wires 12 that are the other (six) wires and are arranged on an outer periphery of the core wire 11 so that each of the side wires 12 is in contact with the core wire 11.

The core wire 11 is a metal wire with a circular cross section that extends from a distal end to a proximal end in the center of the core strand 10. The material of the core wire 11 is not particularly limited, and stainless steel or the like is used, for example. The core wire 11 is formed to have higher Vickers hardness at an outer periphery portion in the transverse section than at a center portion in the transverse section. This keeps the core wire 11 flexible, improves the wear resistance of the core wire 11 in contact with the side wires 12, and improves the bending durability of the core wire 11.

The plurality of side wires 12 are metal wires that are in contact with the core wire 11 and are spirally wound around the core wire 11 along a longitudinal direction of the core wire 11. The material of the core wire 12 is not particularly limited, and stainless steel or the like is used, for example. The transverse sectional shape of the side wire 12 is non-circular and substantially trapezoidal shape. The side wire 12 includes end portions 12A positioned at both ends in a circumferential direction of the core wire 11 in the transverse section. Each of the end portions 12A is in surface contact with the end portion 12A of an adjacent another side wire 12. Each side wire 12 includes an outer peripheral surface 12B exposed to the outside.

The end portion 12A includes a contact portion 12A1 in contact with the end portion 12A of the adjacent another side wire 12, and a non-contact portion 12A2 not in contact with the adjacent another side wire 12. The Vickers hardness of the contact portion 12A1 is configured to be higher than the Vickers hardness of the non-contact portion 12A2. For example, the Vickers hardness of the contact portion 12A1 is configured to be higher by 1% or more than the Vickers hardness of the non-contact portion 12A2. The surface roughness Ra of the outer peripheral surface 12B of the side wire 12 is configured to be 0.10 μm or less.

Similarly to the core strand 10, each side strand 20 also includes a core wire 21 and side wires 22, and has the same configuration as the core strand 10. That is, the side wire 22 includes end portions 22A positioned at both ends in the circumferential direction of the core wire 21 in the transverse section. Each of the end portions 22A is in surface contact with the end portion 22A of the adjacent another side wire 22.

At the end portion 22A, the Vickers hardness of a contact portion 22A1 is configured to be higher than the Vickers hardness of a non-contact portion 22A2. For example, the Vickers hardness of the contact portion 22A1 is configured to be higher by 1% or more than the Vickers hardness of the non-contact portion 22A2, and the surface roughness Ra of an outer peripheral surface 22B of the side wire 22 is configured to be 0.10 μm or less. In this manner, in the side wires 12, 22 of each strand 10, 20, the Vickers hardness of the portion in mutual contact is configured to be higher by 1% or more than the Vickers hardness of the other parts, and the surface roughness Ra of the outer peripheral surface 12B, 22B of the side wire 12, 22 is configured to be 0.10 μm or less. Therefore, it is possible to improve the wear resistance and bending durability of the strands 10, 20. As a result, it is also possible to improve the wear resistance and bending durability of the wire rope 1.

The Vickers hardness of the contact portion 12A1, 22A1 is preferably higher by 3% or more than the Vickers hardness of the non-contact portion 12A2, 22A2, and is more preferably higher by 5% or more. Therefore, it is possible to further improve the wear resistance and bending durability of each strand 10, 20. Moreover, the surface roughness Ra of the outer peripheral surface 12B, 22B of the side wire 12, 22 is preferably 0.04 μm or less.

Figure 4:
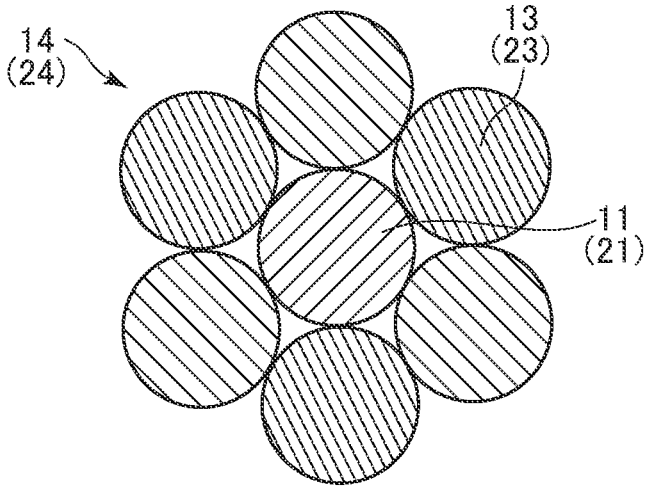
FIG. 4 is a transverse sectional view of a core strand (side strands) in a manufacturing process.

The following will describe an example of a method of manufacturing the wire rope 1. FIG. 4 is a transverse sectional view of a core twisted wire 14 (side twisted wires 24) in the manufacturing process. First, the core strand 10 and a plurality of side strands 20 are formed. The core wire 11 and a plurality of side wires 13 having a circular cross section are first prepared and twisted. In this manner, as illustrated in FIG. 4, the core twisted wire 14 including wires all having a circular cross section is formed. The core twisted wire 14 is subjected to dies-drawing, so as to form the core strand 10 including the side wires 12 having a substantially trapezoidal transverse section, as illustrated in FIG. 3. Also the plurality of side strands 20 are formed, in the same manner as the core strand 10, in that the core wire 21 and a plurality of side wires 23 having a circular cross section are first prepared and twisted to form a side twisted wire 24, as illustrated in FIG. 4. The side twisted wire 24, which includes the wires all having a circular cross section, is then subjected to dies-drawing, so as to form the side strand 20 including the side wires 22 having a substantially trapezoidal transverse section, as illustrated in FIG. 3. The wire rope 1 is manufactured by twisting the core strand 10 and the plurality of side strands 20.

The diameter of the core wire 11, 21 is, for example, 0.05 to 0.07 mm, and the diameter of the side wire 13, 23 is, for example, 0.05 to 0.07 mm. The cross-section width of the core strand 10 after dies-drawing is, for example, 0.12 to 0.18 mm, and the cross-sectional width of the side strand 20 after dies-drawing is, for example, 0.09 to 0.15 mm. The material of the core wire 11, 21 and the side wire 13, 23 is stainless steel.

Figure 5:
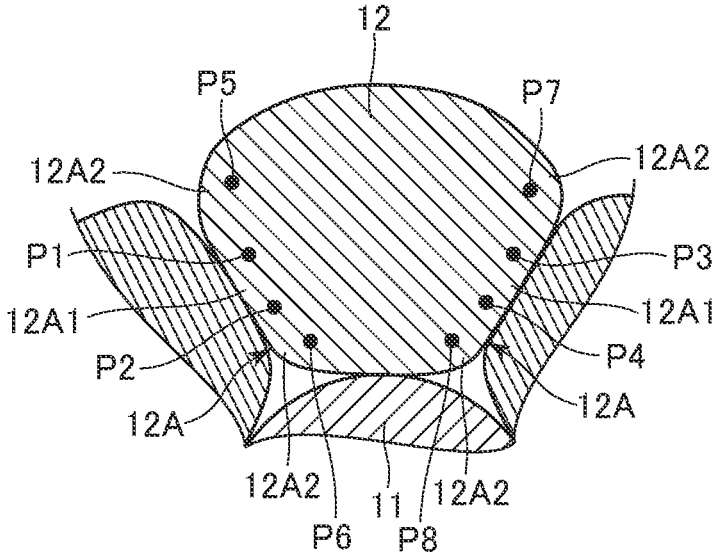
FIG. 5 is an explanatory view of Vickers hardness measurement positions in a side wire of the wire rope.

The following will describe a measurement result of the Vickers hardness for the contact portion 12A1 and the non-contact portion 12A2 in the end portion 12A of the side wire 12 of the wire rope 1 formed by the above-described manufacturing method. FIG. 5 is an explanatory view of Vickers hardness measurement positions in the side wire 12 of the wire rope 1.

The core strand 10 is cut at an arbitrary position in the longitudinal direction thereof, and the Vickers hardness is measured for measurement points P1 to P8 in the contact portion 12A1 and the non-contact portion 12A2 of the end portion 12A of the side wire 12. The measurement points P1 to P8 are each positioned in a range of 10 to 20 μm from the surface of the side wire 12. It is possible to measure the Vickers hardness by a method conforming to JIS Z 2244: 2009, with the use of a micro Vickers hardness tester (for example, a micro Vickers hardness tester by SHIMADZU CORPORATION). The test load is set to 1 kgf (9.8N).

The average value of the Vickers hardness for the measurement points P1 to P4 is regarded as the Vickers hardness of the contact portion 12A1, while the average value of the Vickers hardness for the measurement points P5 to P8 is regarded as the Vickers hardness of the non-contact portion 12A2. The Vickers hardness of the contact portion 12A1 is around 605 HV, and the Vickers hardness of the non-contact portion 12A2 is around 570 HV. In this manner, at the end portion 12A, the Vickers hardness of the contact portion 12A1 is configured to be higher than the Vickers hardness of the non-contact portion 12A2. Specifically, the Vickers hardness of the contact portion 12A1 is configured to be higher by at least 1% or more than the Vickers hardness of the non-contact portion 12A2. In this manner, the contact portion 12A1 is formed to be harder than the non-contact portion 12A2, which improves the wear resistance and bending durability of the wire rope 1. The Vickers hardness of the contact portion 12A1 is preferably higher by 3% or more than the Vickers hardness of the non-contact portion 12A2, and is more preferably higher by 5% or more.

Note that although, as a comparative example, the Vickers hardness has been similarly measured also for a core strand formed by performing swaging processing on the core twisted wire 14 including wires all having a circular cross section, the measurement values had no difference between the contact portion and the non-contact portion.

The following will describe a measurement result of the surface roughness of the outer peripheral surface 12B, 22B of the side wire 12, 22 of the strand 10, 20 formed by the above-described manufacturing method. The surface roughness is calculated by measuring and averaging the Ra of the outer peripheral surfaces 12B, 22B of the side wires 12, 22 forming the strand 10, 20. Specifically, for example, as illustrated in FIG. 3, assuming that a width in the circumferential direction of the wire 12, 22 forming the strand 10, 20 is D, the surface roughness of the range of D/5 around the middle M of the outer surface 12B, 22B of the wire 12, 22 is measured. Then, the surface roughness of the side wires 12, 22 is averaged. At arbitrary positions in an axial direction of the wire rope 1, the surface roughness Ra of the outer peripheral surfaces 12B, 22B of the respective side wires 12, 22 has been measured. Regarding the surface roughness Ra of the outer peripheral surface 12B, 22B of the side wire 12, 22, the arithmetic average roughness (Ra) has been measured conforming to JIS B 0601, for example, with the use of a surface property measuring machine (for example, a laser microscope by KEYENCE CORPORATION). The average value of all measured surface roughness Ra is 0.04 μm.

Note that as a comparative example, the surface roughness Ra has been similarly measured also for a core strand formed by performing swaging processing on the core twisted wire 14 including wires all having a circular cross section, and the minimum value is 0.12 μm. With this, it is not possible to improve the bending durability of the wire rope. Therefore, in the embodiment, the surface roughness Ra of the outer peripheral surface 12B of the side wire 12 is configured to be 0.10 μm or less. This allows the surface roughness of the outer peripheral surface 22B of the side wire 22 to be considerably smooth, which improves the wear resistance and bending durability of the wire rope 1.

The bending durability evaluation has been performed for the wire rope 1 of the above-described embodiment and a wire rope of the comparative example. In the bending durability evaluation, the wire rope 1 and a wire rope of the comparative example having an outer diameter of about 0.45 mm are used, and drawn by a pulley with a diameter of 10 mm while tensile force of 2.5 kgf is applied thereon, and the number of times before the ropes are broken is measured. The results are shown in FIG. 6.

Figure 6:
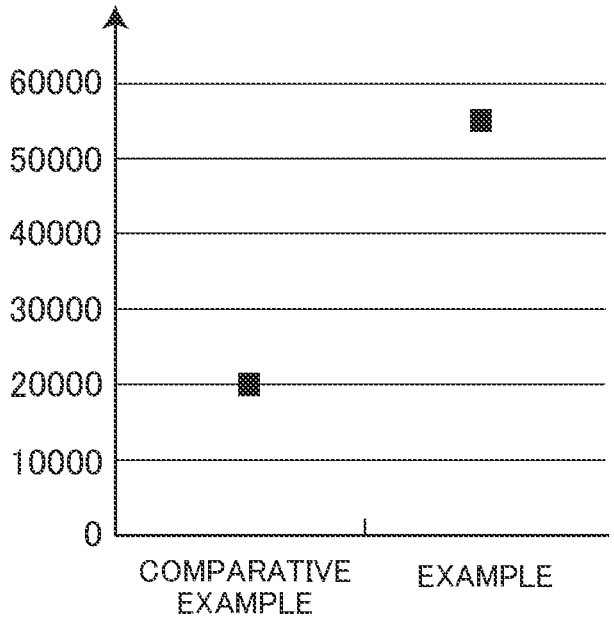
FIG. 6 is a diagram showing an evaluation result of bending durability.

As is found from the above-described FIG. 6, the number of times of bending durability is about 20000 times in the wire rope of the comparative example with almost no difference in Vickers hardness at the contact portion, while the number of times of bending durability is about 55000 times in the wire rope 1 of the embodiment with higher Vickers hardness at the contact portion, which shows notable improvement in bending durability.

Note that the present disclosure is not limited to the configuration of the above-described embodiments, but is defined by the terms of the claims and is intended to include any modifications within the scope and meaning equivalent to the terms of the claims.

For example, the number of side strands 20 and the number of wires forming the core strand 10 and the side strand 20 in the wire rope 1 according to the above-described embodiment is variously modified.

In the strand, at the end portion, the Vickers hardness of the portion in contact with an end portion of adjacent another side wire may be higher by 3% or more than the Vickers hardness of the portion not in contact with the adjacent another side wire.

The wire rope according to one aspect of the present disclosure may be formed by winding a plurality of the above-described strands.

What is claimed is:

1. A wire rope, comprising:

a strand that is formed by winding a plurality of metal wires, wherein:

the strand includes a core wire arranged in a center of the plurality of metal wires, and side wires that make up a remainder of the plurality of metal wires, each of the side wires being arranged on an outer periphery of the core wire, in a transverse section of the strand, each of the side wires includes end portions positioned at opposite ends in a circumferential direction of the core wire, each of the end portions includes a contact portion in contact with an end portion of an adjacent side wire, and a non-contact portion not in contact with the adjacent side wire, a Vickers hardness of the contact portion is higher by 1% or more than a Vickers hardness of the non-contact portion, a surface roughness Ra of an outer peripheral surface of each of the side wires is 0.10 μm or less, the strand is obtained by die-drawing a twisted wire including a plurality of circular-cross-section metal wires, and a cross-sectional width of the strand is 57.2% to 85.7%, or 42.9% to 71.4%, of a diameter of the twisted wire before the die-drawing.

2. The wire rope according to claim 1, wherein at each of the end portions, the Vickers hardness of the contact portion is higher by 3% or more than the Vickers hardness of the non-contact portion.

3. The wire rope according to claim 1, further comprising a plurality of strands including the strand, wherein the wire rope is formed by winding the plurality of the strands.

* * * * *